US006145999A

United States Patent [19]

Van Derlande

[11] Patent Number: 6,145,999

[45] Date of Patent: Nov. 14, 2000

[54] BATTERY DEVICE

[76] Inventor: Jan Van Derlande, W. 79th St. Marina, #77, New York, N.Y. 10024

[21] Appl. No.: 09/271,807

[22] Filed: Mar. 18, 1999

[51] Int. Cl.[7] ..... F21S 13/14

[52] U.S. Cl. ..... 362/252; 362/195; 362/198

[58] Field of Search ..... 362/194, 195, 362/198, 252, 250, 806

[56] References Cited

U.S. PATENT DOCUMENTS

| | | | |
|---|---|---|---|
| 4,556,932 | 12/1985 | Lehrer et al. | 362/103 |
| 4,654,766 | 3/1987 | Tung | 362/249 |
| 4,675,575 | 6/1987 | Smith et al. | 315/185 |
| 4,866,580 | 9/1989 | Blackerby | 362/205 |
| 4,870,325 | 9/1989 | Kazar | 315/178 |
| 5,058,900 | 10/1991 | Denen | 273/416 |
| 5,266,063 | 11/1993 | Baumgartner, Jr. | 362/198 X |
| 5,655,830 | 8/1997 | Ruskouski | 362/240 |

*Primary Examiner*—Stephen Husar

[57] ABSTRACT

A battery device comprising a battery, which comprises a first battery contact and a second battery contact, each contact located on an upper surface of the battery. A connection means functions to releasably attach to the first battery contact and second battery contact. A first vertical member, extending generally vertically from the connection means is substantially aligned with first battery contact, and a second vertical member, extends generally vertically from the connection means and is substantially aligned with second battery contact. A generally pliable upper member is securely affixed to upper distal ends of the first vertical member and second vertical member, the upper member formed into a previously determined shape recognizable by a user. The upper member includes an illumination means thereon, the illumination means powered by the battery utilizing first vertical member and second vertical member as conduits therefor. In the preferred mode, the illumination means comprises a plurality of colored LED devices thereon.

11 Claims, 2 Drawing Sheets

BATTERY DEVICE

BACKGROUND OF THE INVENTION

1. Field of the Invention

The present invention is a battery device. More specifically, the present invention is a unique ornamental design that utilizes a standard battery, such as a 9-volt battery, and includes the use of wires extending vertically from both contacts of the battery, forming ornamental shapes such as stars, trees, flowers, or hearts. Utilizing previously existing LED means, the device provides illumination in addition to such multiple aesthetically pleasing configurations.

2. Description of the Prior Art

Numerous innovations for communication to athletes taking part in sporting events have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the present invention and the prior art.

In U.S. Pat. No. 4,870,325, titled Ornamental Light Display Apparatus, invented by Kazar, described is an improved decorative lighting display using LEDs, CMOS integrated circuits and high current MOS transistors. This display provides for an extremely large configuration of LEDs to be driven at low average power and at the same time allows the user to select individual lights to be constantly illuminated or flashed in response to an oscillating voltage source. Moreover, this display allows multicolor patterns to be generated using bicolor LEDs.

In U.S. Pat. No. 5,058,900, titled General Purpose Illumination Assembly, invented by Denen, described is an illuminator assembly is disclosed which is formed from a light emitting diode (LED) having two electrode pins extending therefrom which are cut to predetermined lengths. One lead then is formed to provide a circularly shaped spring support base and the other lead is bent to provide an attachment potion extending through the center of the opening formed by the spring support base. A capture spring of conical configuration then is attached to the centrally disposed lead which extends through the spring support base opening. A compressible coil switching spring then is attached to the spring support base. The assemblage thus formed is employed with a battery of a variety having a forward face which engages the free end of the switching spring and which includes a rod shaped electrode extending from the center portion thereof Upon providing relative mutually approaching movement of a battery and illuminator assembly, the rod-like cathode is engaged by the capture spring and an electrical circuit is completed to illuminate the LED. Conversely, the releasing or reverse movement under the drive imparted by the switching spring switches the assemblage to an open circuit condition.

In U.S. Pat. No. 4,866,580, titled Ornamental Lighting Device, invented by Blackerby, described is a self-powered ornamental lighting device which includes a housing wall defining a chamber therein and a power source disposed in the housing chamber. One or more LEDS are mounted in the housing wall whereby light emitted by the LED is transmitted to the ambience. Circuit means are disposed in the housing chamber for connecting the power supply and the LEDS for causing the LEDS to emit light. A removable cover member provides access to the housing chamber. In one embodiment of the invention the LEDS are provided with light enhancing members which serve to disburse, direct, reflect or otherwise modify the light emitted from the LEDS. In another embodiment of the invention a remote control system is provided for control of the on/off function of the lighting device.

In U.S. Pat. No. 4,675,575, titled Light Emitting Diode Assemblies And Systems Therefor, invented by Smith, a light string system is provided having a plurality of monocolor or bi-color light-emitting diodes electrically connected thereto. Each light-emitting diode has a generally elongated, hollow envelope mounted thereover, and the envelope is substantially filled with light-conducting optical spheres or even fragments. The envelope may be additionally filled with light-conducting epoxy, light-conducting liquid or light-conducting gas and sealed for improved light transmission and dispersion characteristics. The light-emitting diodes may include an improved base with light-emitting diode leads disposed approximately perpendicular to the axis of the envelope for bulb stability and for enabling the bulb to stand upright on the branches. Both the envelope and the optical spheres include light-conducting glass or plastic material. The spheres may be either hollow or spherical and may be of a uniform or a mixed size. Additionally, the balls may be large for stacking in single file within the envelope or centrifuged to the sides of the envelope with the center devoid of spheres. The light-emitting diodes may be adapted for use as Christmas tree strings and various AC and DC control circuits are provided for driving the light-emitting diodes, for blinking effects, for alternating between two colors, for alternating between three colors, for improving the length of the string and uniformity of intensity of illumination and the like. In a preferred embodiment of the Christmas tree string of lights, a master trunk line and a plurality of limb lines are provided. The limb lines plug into or connect to predetermined locations along the master trunk line for ease of assembly, replacement and the like. This string uses a series—parallel configuration wherein the upper and lower portion of the master trunk line and the individual light-emitting diodes within each limb line are connected in series while the limb line sets are connected in parallel with each other for enabling more lights to be illuminated with less power, for increasing the uniformity of illumination along the length of the string, and for minimizing light outage due to bulb burnout.

In U.S. Pat. No. 4,654,766, titled Structure For A String Of Bulbs, invented by Tung, disclosed is a bulb seat structure that serves to replace the conventional bulb seat in a string of bulbs. In assembling operation, the two conductive rods of the bulb are inserted into the grooves of the bulb seat, and two wires are twisted into a spiral wire to connect all bulbs in parallel to form a string of bulbs.

In U.S. Pat. No. 4,556,932, titled Lighted Novelty Item, invented by Lehrer, disclosed is a battery-powered, self-contained lighted novelty item that incorporates a removable face plate. A square, transparent area formed on the center of the face plate is superimposed over a prism shaped lens within the novelty item. An electrical circuit including a light emitting diode is included within the novelty item to illuminate the transparent area on the face plate. A design or figure applied to the face plate, and in particular to the transparent area on the center of the face plate, will be illuminated when the electrical circuit is completed and the light emitting diode is energized.

In U.S. Pat. No. 5,655,830, titled Lighting Device, invented by Ruskouski, disclosed is a long life, low maintenance and low energy consumption-lighting device for connection with an electrical socket within a housing of an exit sign comprises a string of series connected light emitting diodes connected in a circuit comprising a capacitor for limiting the current flow through the light emitting diodes and a resistor to limit the surge current through the light emitting diodes. The resistor, capacitor and light emitting diodes are connected to the socket by one of several different standard light bulb bases and are housed within a hollow translucent or transparent tube connected to the base. A surge suppression device, such as a TRANSZORB, may be connected in parallel with the resistor, capacitor and light emitting diodes to provide line transient protection for protecting the light emitting diodes in response to transient voltage spikes. The lighting device may be provided with a pair of series connected light emitting diode strings connected in parallel with one another, the diodes in one string being connected in opposite polarity to the diodes in the other string. Additionally, the light emitting diodes may be either discrete light emitting diodes or die-on type light emitting diodes mounted on one or both sides of a printed circuit board.

As outlined above, the prior art patents that relate to ornamental battery designs largely entail elements such as: a device that allows the user to select individual lights to be illuminated or flashed in response to an oscillating voltage source; movement under a drive imparted by the switching spring; LEDs with light enhancing members which serve to disburse, direct, reflect or otherwise modify the light emitted from the LEDS; an envelope that is filled with light-conducting optical spheres; a bulb seat structure that serves to replace the conventional bulb seat; a face plate that is superimposed over a prism shaped lens within a novelty item; and a low energy consumption-lighting device for connection with an electrical socket.

In contrast, the present invention utilizes a battery that includes wires extending vertically from the contacts, forming a variety of ornamental shapes. By utilizing an LED means, the present invention uniquely interesting configurations and illumination, in a simple and inexpensive assembly.

SUMMARY OF THE INVENTION

As previously noted, the present invention is a unique ornamental design that utilizes a standard battery, such as a 9-volt battery, and includes the use of wires extending vertically from both contacts of the battery, forming ornamental shapes such as stars, trees, flowers, or hearts. Utilizing previously existing LED means, the device provides illumination in addition to such multiple aesthetically pleasing configurations.

In the preferred mode, the device utilizes the nine-volt battery as both the power means and support structure. The wires extending vertically from each battery contact are generally pliable in nature. Such wires comprise multiple points of illumination thereon, such illumination means in the form of between five and ten LED devices in the preferred embodiment. The wires may be formed into a variety of shapes including, but not limited to simple figures, letters, or numbers. In all such instances, the LED devices may be of varying sizes and colors.

With the foregoing in mind, it is an object of the present invention to provide an aesthetically pleasing device that may be used for amusement purposes.

It is another object of the present invention to provide a device that is effective for product promotion and marketing services.

It is still another object of the present invention to provide a device that is relatively inexpensive to manufacture, utilizing relatively inexpensive materials therewith.

It is a further object of the present invention to provide a device that may vary in size according to the needs of the purchaser or user.

It is another object of the present invention to provide a device that may be designed in accordance with holiday themes, including but not limited to shaping the device in the form of trees, hearts, shamrocks, pumpkins, turkeys, or flags.

It is still a further object of the present invention to provide a device that may feature blinking or flashing LED devices, for increased novelty associated therewith.

It is another object of the present invention to provide a device that is relatively easy to assemble and disassemble for the convenience of the user.

It is a further object of the present invention to provide a device that may include indicia thereon, for increased effectiveness in product or theme promotion.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF THE PREFERRED EMBODIMENT

DETAILED DESCRIPTION OF THE PREFERRED EMBODIMENT

Figure 1:
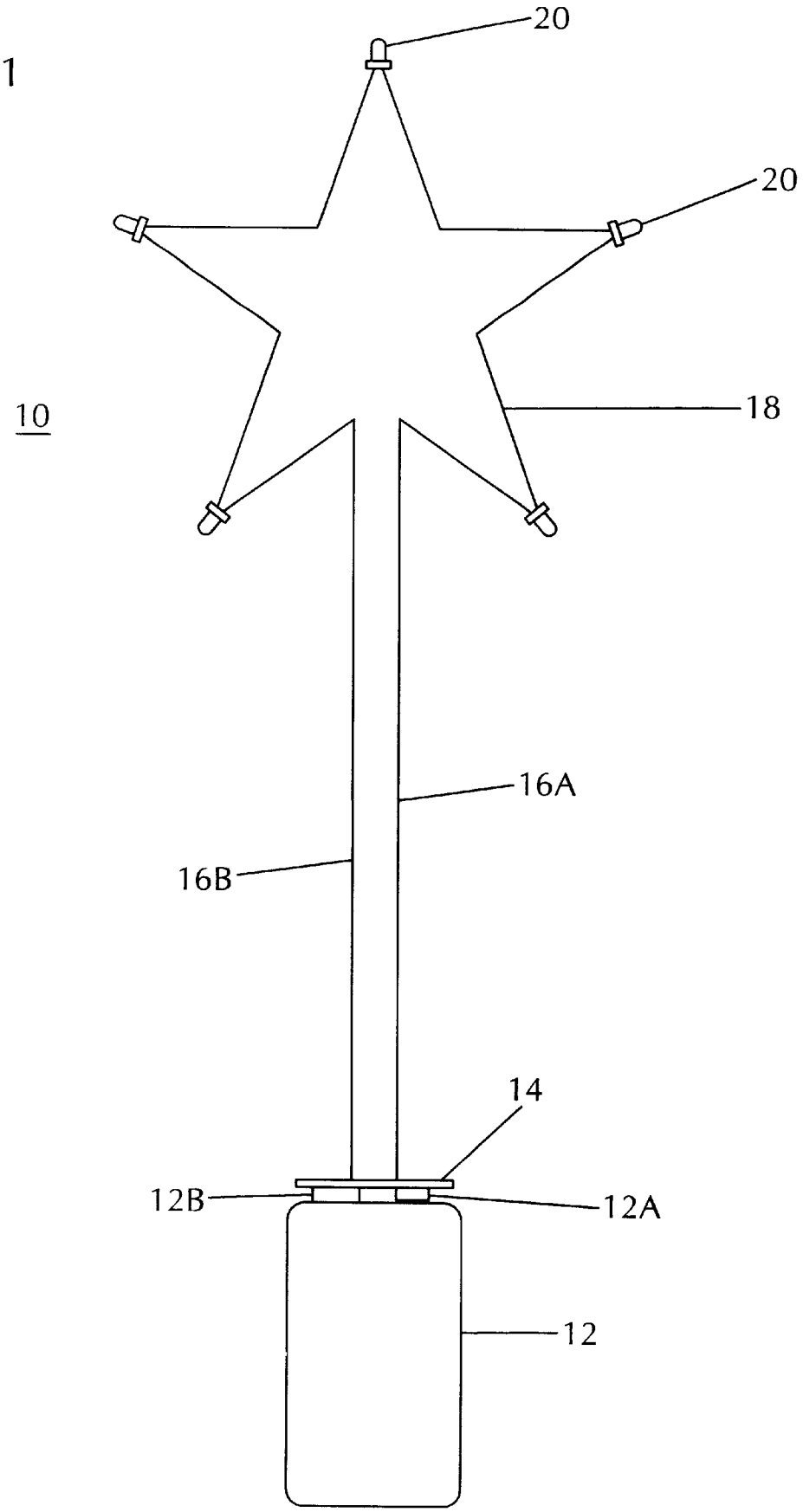
FIG. 1 is a front perspective view of the battery device in the form of a five-point star, exhibiting illumination means thereon.
Figure 2:
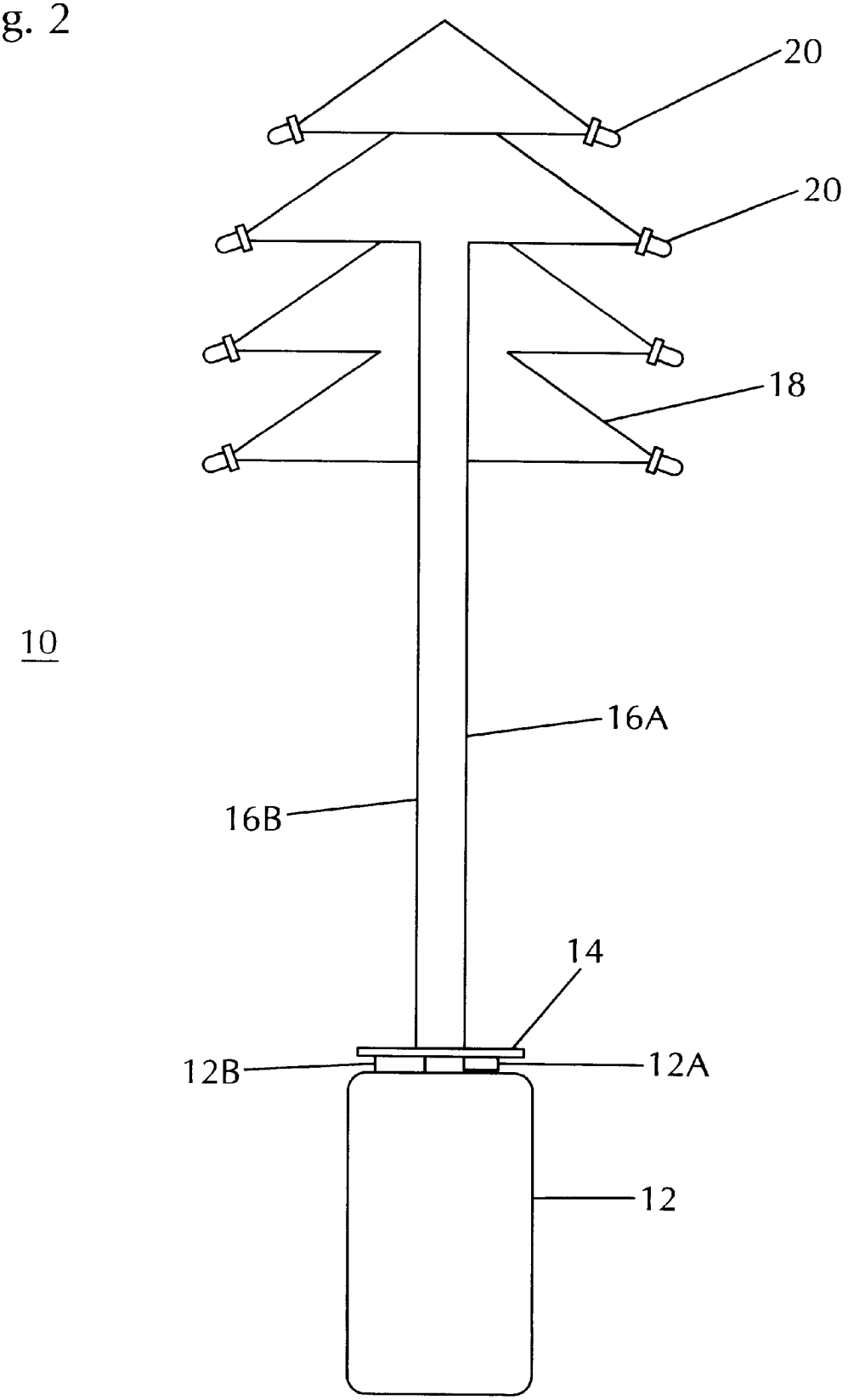
FIG. 2 is a front perspective view of the battery device in the form of a tree, exhibiting illumination means thereon.

Referring to both FIG. 1, which is a front perspective view of the battery device in the form of a five-point star, exhibiting illumination means thereon, and FIG. 2, which is a front perspective view of the battery device in the form of a tree, exhibiting illumination means thereon, illustrated is a battery device (10), battery (12), first battery contact (12A), second battery contact (12B), connection means (14), first vertical member (16A), second vertical member (16B), upper member (18), and illumination means (20).

More particularly, a battery device (10) comprises a battery (12), which comprises a first battery contact (12A), and a second battery contact (12B). As is standard in traditional pre-existing batteries, each contact is located on an upper surface of the battery (12). A connection means (14) then functions to releasably attach to the first battery contact (12A) and second battery contact (12B). Such connection means is generally horizontal in configuration and is approximately the same width as the battery itself.

A first vertical member (16A) extends generally vertically from the connection means (14) and is substantially aligned with first battery contact (12A).

Similarly, a second vertical member (16B), extends generally vertically from the connection means (14) and is substantially aligned with second battery contact (12B). More importantly, a generally pliable upper member (18) is securely affixed to upper distal ends of both the first vertical member (16A) and second vertical member (16B).

The upper member (18), which is a relatively thin in diameter, lightweight wire device, is formed into a previously determined shape recognizable that is intended to be readily by a user.

In accordance with the aforementioned objects of the present invention, the upper member further comprises an illumination means (20) thereon. The illumination means (20) is powered by the battery (12) by utilizing the first vertical member (16A) and second vertical member (16B) as conduits therefor.

In the preferred mode, the battery is a nine-volt battery which functions as a base support structure for the first vertical member (16A), second vertical member (16B), and upper member (18). Moreover, the illumination means comprises a plurality of LED devices.

Such LED devices may illuminate in varying colors, wherein either the entire device utilizes the same LED color selected form a vast variety of colors, or the device itself utilizes several different colors, such as one color for each LED device included on the upper member.

In an alternate mode of manufacture, the LED devices may flash and illuminate in previously determined alternate increments, for increased effectiveness in gaining the attention of the user and entertaining and amusing the user..

In all such instances, it is intended that the upper member be formed into a shape to accomplish the objects of the invention, wherein such shape is suitable for ornamental display or product promotion. For the purposes of example only, the shape may be selected from the group consisting of a five-point star, a six-point star, a tree, a flower, a heart, a shamrock, a pumpkin, a turkey, a flag, a snowflake, a face, a person, an animal, at least one letter, and at least one number. One example of a number to be displayed includes the upper member of the present invention being formed in the general configuration of the number "2000" for millennium celebration purposes.

In another alternate mode of manufacture of the present invention, the device includes indicia thereon, wherein such indicia is suitable for the effective communication of the represented by the present invention, be it for holiday celebration, particular character representation, or product promotion.

With the foregoing in mind, the battery of the present invention may also be substantially covered by an outer covering means, so as to enhance the overall appearance of the device as well as provide additional space and surface upon which to communicate a theme or message. Similarly, the first vertical member (16A) and second vertical member (16B) may be substantially covered by an outer covering means.

Regarding the convenience and capability of the present invention, the device may be easily assembled and disassembled by a user, as the first vertical member (16A) and second vertical member (16B) may be easily plugged into the battery (12) by way of the traditionally designed connection means (14).

Finally, for the benefit of the user and providing the utmost in versatility, the generally pliable upper member (18) may be formed into a previously determined desired shape by the user himself, wherein the upper member (18) will retain its new form and allow for a unique ornamental device of particular significance to the individual user.

It will be understood that each of the elements described above, or two or more together, may also find a useful application in other types of constructions differing from the type described above.

While the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can, by applying current knowledge, readily adapt it for various applications without omitting features that, from the standpoint of prior art, constitute essential characteristics of the generic or specific aspects of this invention.

What is claimed as new and desired to be protected by Letters Patent is set forth in the appended claims:

1. A battery device (10) comprising:

A) a battery (12), which comprises a first battery contact (12A), and a second battery contact (12B), each contact located on an upper surface of the battery (12);

B) a connection means (14) functioning to releasably attach to the first battery contact (12A) and second battery contact (12B);

C) a first vertical member (16A), extending generally vertically from the connection means (14) substantially aligned with first battery contact (12A);

D) a second vertical member (16B), extending generally vertically from the connection means (14) substantially aligned with second battery contact (12B); and E) a generally pliable upper member (18), securely affixed to upper distal ends of the first vertical member (16A) and second vertical member (16B), the upper member (18) formed into a previously determined shape recognizable by a user, the upper member further comprising an illumination means (20) thereon, the illumination means (20) powered by the battery (12) utilizing first vertical member (16A) and second vertical member (16B) as conduits therefor.

2. The battery device (10) as described in claim 1, wherein the battery is a nine-volt battery which functions as a base support structure for the first vertical member (16A), second vertical member (16B), and upper member (18).

3. The battery device (10) as described in claim 1, wherein the illumination means comprises a plurality of LED devices.

4. The battery device (10) as described in claim 3, wherein the LED devices illuminate in varying colors.

5. The battery device (10) as described in claim 3, wherein the LED devices flash and illuminate in previously determined alternate increments.

6. The battery device (10) as described in claim 1, wherein the upper member is formed into a shape selected from the group consisting of a five-point star, a six-point star, a tree, a flower, a heart, a shamrock, a pumpkin, a turkey, a flag, a snowflake, a face, a person, an animal, at least one letter, and at least one number.

7. The battery device (10) as described in claim 1, wherein the device includes indicia thereon.

8. The battery device (10) as described in claim 1, wherein the battery is substantially covered by an outer covering means.

9. The battery device (10) as described in claim 1, wherein the first vertical member (16A) and second vertical member (16B) are substantially covered by an outer covering means.

10. The battery device (10) as described in claim 1, wherein the device may be easily assembled and disassembled by a user.

11. The battery device (10) as described in claim 1, wherein the upper member (18) may be formed into a previously determined desired shape by a user.

* * * * *